United States Patent [19]

Hurst

[11] 4,354,441

[45] Oct. 19, 1982

[54] MOUNTING BLOCK FOR TUFTING MACHINE GAUGE PARTS

[76] Inventor: Kenneth Hurst, 3222 S. Mission Oaks Dr., Chattanooga, Tenn. 37412

[21] Appl. No.: 230,507

[22] Filed: Feb. 2, 1981

[51] Int. Cl.[3] ..... D05C 15/00

[52] U.S. Cl. ..... 112/79 R

[58] Field of Search ..... 112/79 R

[56] References Cited

U.S. PATENT DOCUMENTS

| | | | |
|---|---|---|---|
| 4,161,147 | 7/1979 | Lund | 112/79 R |
| 4,195,580 | 4/1980 | Hurst | 112/79 R |
| 4,217,837 | 8/1980 | Beasley | 112/79 R |

*Primary Examiner*—Ronald Feldbaum

*Attorney, Agent, or Firm*—Alan Ruderman

[57] ABSTRACT

Mounting blocks for carrying a plurality of tufting machine gauge parts have a body member including a pair of elongated space flanges between which a gauge part retainer is positioned. The retainer includes a plurality of slots for receiving the mounting portions of the gauge parts transversely to the elongated direction. The slots open into a channel in the retainer which receives a clamping member for securing the gauge parts in the retainer and the retainer within the body member. The body member may also include an elongated channel opening onto the channel of the retainer so that a portion of the clamping member is in each channel, or the channel in the body member may open onto the retainer surface opposite to that in which the retainer channel is formed, in which case a clamping member is received in each channel.

9 Claims, 3 Drawing Figures

MOUNTING BLOCK FOR TUFTING MACHINE GAUGE PARTS

BACKGROUND OF THE INVENTION

This invention relates to the mounting of tufting machine gauge parts, and more particularly to a mounting block assembly for carrying a plurality of loopers or knives in a tufting machine.

In a tufting machine each reciprocating needle cooperates with a looper which seizes a loop of yarn from the needle and releases the loop to form loop pile fabric or holds the loop until it is cut by a knife acting against the side of the looper to form cut pile fabric. The gauge of the pile fabric produced and of the tufting machine is equal to the spacing between adjacent needles, loopers and knives, i.e. the gauge parts. As the required gauge of the pile fabric becomes finer the spacing between adjacent gauge parts becomes more difficult to attain with the required precision. To overcome this difficulty modular gauge parts units have been proposed in which a plurality of respective looper shanks or knife ends are imbedded in a common body member in side-by-side disposition. Although such a construction substantially eliminates the difficulties of aligning the gauge parts, it has the disadvantage of not having the capability of replacement of loopers or knives should they break. In my U.S. Pat. No. 4,195,580 there is disclosed a gauge parts mounting block having a plurality of grooved retaining plates positioned between and secured to spaced flanges of a body member to which they are bonded. Each groove receives the mounting portion or shank of a respective looper or knife.

SUMMARY OF THE INVENTION

The present invention is an improvement of the mounting blocks disclosed in my aforesaid patent and provides a tufting machine gauge part mounting block for carrying a plurality of loopers or knives and which comprises a body member adapted to be mounted in a tufting machine and having a pair of spaced flanges between which a retaining insert is positioned. The retaining insert includes a plurality of spaced slots for receiving the mounting portions of the gauge parts. The slots extend from a surface of the retaining insert in abutment with one of the flanges of the body member toward the surface that abuts the other flange and opens into a channel formed in the retaining insert. A clamping member positioned within the channel acts between the adjacent flange and the mounting portion of the gauge parts for securing the gauge parts within the slots and the retaining insert within the body member. In one form of the invention the body member flange adjacent the channel includes a cooperating similarly disposed channel and the clamping member is disposed in both channels. In this construction the gauge parts may have a notch for receiving the clamping member. In another form of the invention the flange of the body member spaced from the retaining insert channel includes a second channel and receives another clamping member.

Consequently, it is a primary object of the present invention to provide a gauge parts mounting block for tufting machines for mounting a plurality of closely spaced readily replaceable gauge parts.

It is another object of the invention to provide a tufting machine gauge parts mounting block including a body member having a pair of spaced flanges between which a retainer is positioned, the retainer having a plurality of slots for receiving the gauge parts and means for securing the gauge parts in the slots and the retainer in the body member.

It is a further object of the present invention to provide a tufting machine gauge parts mounting block including a body member having a pair of spaced flanges between which a retainer is positioned, the retainer having a plurality of slots for receiving the gauge parts, the slots extending from a surface of the retainer abutting one of the flanges of the body member toward the surface that abuts the other flange and opens onto a channel formed in the retaining insert, a clamping member being positioned within the channel for securing the gauge parts within the slots and the retainer within the body member.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
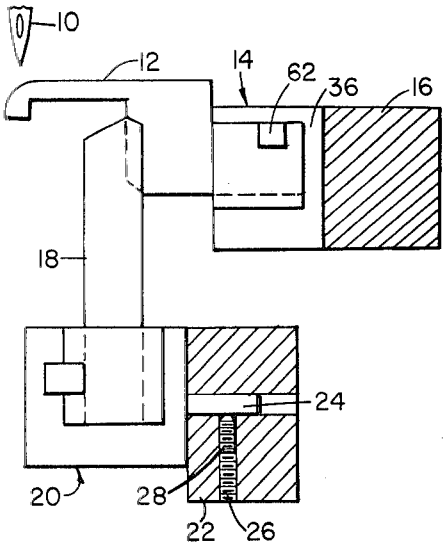
FIG. 1 is a vertical sectional view taken transversely through the looper and knife shafts of a cut pile tufting machine incorporating looper and knife mounting blocks constructed in accordance with the principles of the present invention.
Figure 3:
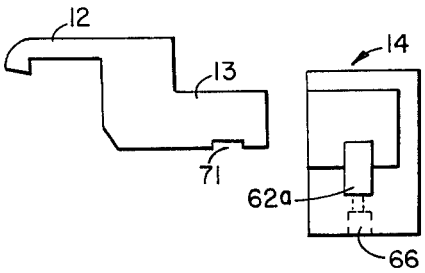
FIG. 3 is an end elevational view of the looper block of FIG. 2 with a modification of the clamping means for securing the loopers within the retainer slots and the retainer within the body member and with a looper disassembled therefrom.

Referring to FIG. 1, the relevant portions of a cut pile tufting machine are illustrated including needles 10 which may be reciprocated in a conventional manner to cooperate with respective loopers 12. The loopers, as illustrated in FIG. 3, have elongated mounting portions or shanks 13 which are supported in a looper mounting block generally indicated at 14 constructed in accordance with the principles of the present invention as hereinafter described. The looper support block is carried by a looper block support bar 16 suitably secured to a rocker arm (not illustrated) conventionally for oscillating the loopers back and forth into cooperative engagement with the needles in a known manner.

In a cut pile tufting machine the loopers 12 cooperate with respective knives 18 carried by knife blocks generally indicated at 20 which as illustrated also may be constructed in accordance with the principles of the present invention. Each knife block 20 in turn is supported on a knife bar 22 by means of a stud shaft 24 received within a bore 26 and secured by fastening means such as set screw 28. As is well known in the art, and thus not illustrated, the knife bar may be clamped to a rocker arm secured to an oscillating knife shaft to oscillate the knives back and forth into cutting engagement with the loopers to cut loops of yarn thereon.

In accordance with the principles of the present invention, the preferred form of the looper blocks 14 each comprise a body member 30 elongated in the direction transverse to the supported loopers and having a pair of similarly elongated flanges 32 and 34 spaced apart one from the other and connected together by a web 36.

Preferably, the body member is a unitary member, but it is envisioned that the various sections, i.e. the flanges and web may comprise individual members joined together as by welding or the like. The flanges 32, 34 having facing surfaces 38 and 40 respectively, 38 being the underside of flange 32, which preferably, as illustrated, are parallel to each other and together with the adjoining surface 42 of the web 36 define a guideway for receiving a looper retainer 44.

The retainer 44 comprises a substantially rectangular body member having a pair of elongated surfaces 46 and 48 spaced apart by an amount substantially equal to the spacing between the flange surfaces 38 and 40, and front and rear surfaces 50 and 52 respectively. The geometric configuration of the retainer is such that it is receivable within the guideway with the rear surface 52 abutting the surface 42 of the web 36 and the front surface 50 preferably in substantially the same plane as the front surfaces of the flanges 32, 34.

Formed in the retainer transversely to the elongated surfaces 46 and 48 are a plurality of slots 54. The slots 54 are each rectangular in cross section for receiving the similarly shaped and sized shanks 13 of the loopers 12 and may be machined into the retainer by sawing or by other convenient means to extend from the surface 50 preferably to the surface 52. The slots 54 extend from the surface 48 of the retainer to a depth substantially equal to slightly more than the height of the looper shanks 13 and terminate at a location spaced from the surface 46.

Machined, as by milling, in the elongated surface 46, substantially medially between the surfaces 50, 52 is an elongated channel 55 defined between facing walls 56 and 58, and floor 60. The depth of the channel walls 56, 58 is such that the slots 54 open into the channel and extend slightly above the floor 60 thereof. The looper shanks are thus receivable within the slots 54 and extend slightly above the floor 60 of the channel. With the retainer positioned within the guideway of the body member 30, a clamping member 62 is slideably positioned within the channel and disposed on the upper surfaces of the looper shanks 13. To provide for slight variations in the heights of the looper shanks the clamping member 62 may have a plurality of grooves 64 (depicted rotated 90° in FIG. 2) for engagement with the loopers. The clamping member is forced into clamping engagement with the shanks by means of fasteners such as set screws 66 threaded into holes 68 in the flange 32 and into abutment with the clamping member, the screws also acting to secure the retainer in the body member 30. The body member includes means such as a hole 69 for receiving a fastening bolt or the like (not illustrated) to mount the assembly in the tufting machine.

Figure 2:
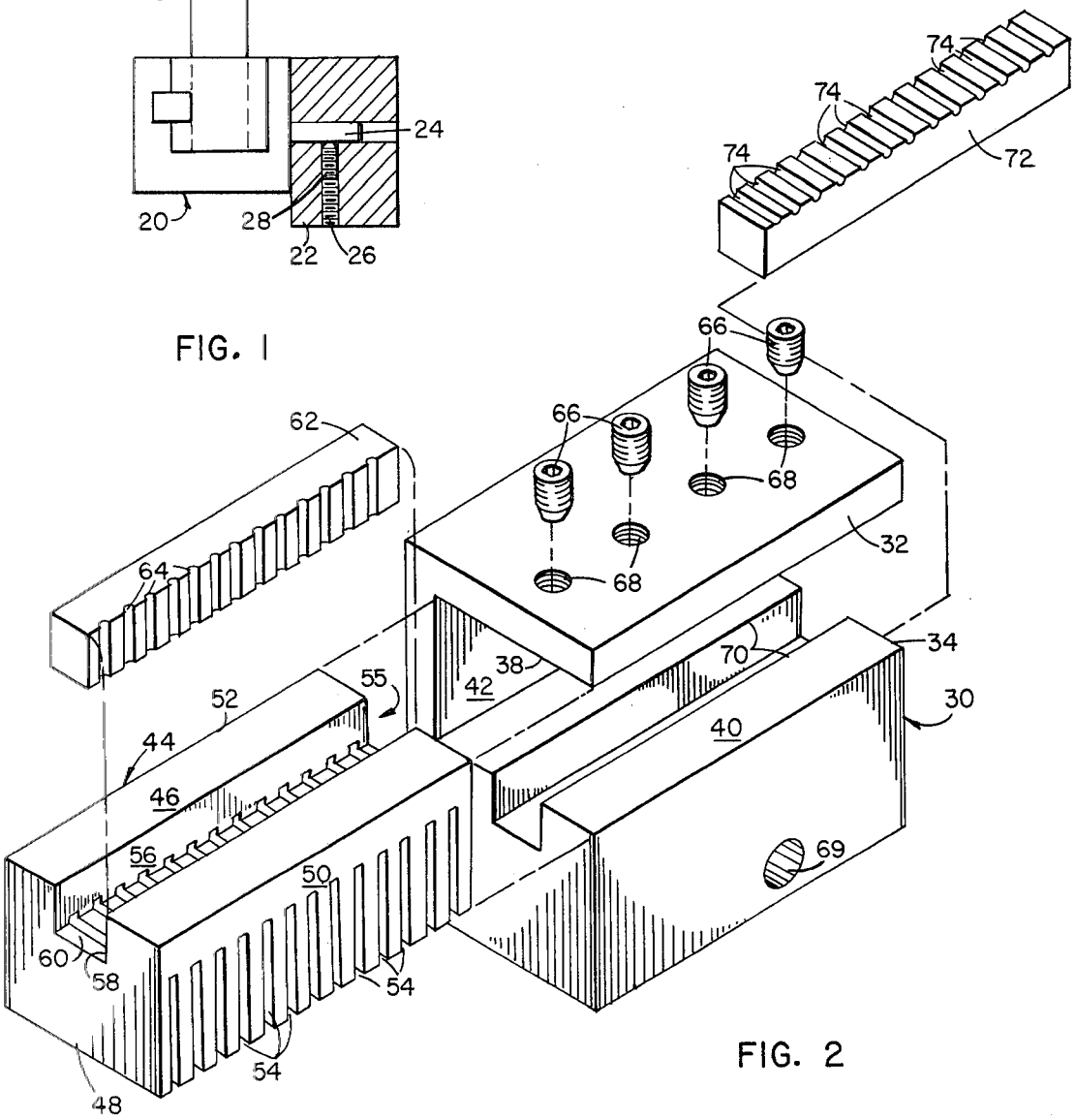
FIG. 2 is a disassembled perspective view of the looper mounting block illustrated in FIG. 1.

As illustrated in FIG. 2, the body member 30 may also have a channel 70 formed in the surface 40 thereof and, as illustrated in FIG. 3, the retainer may be inverted with relation to the disposition shown in FIGS. 1 and 2 so that its channel 55 opens into the channel 70. With this construction a clamping member **62*a* may be disposed within both channels to secure the retainer and loopers. The clamping member 62*a* may engage the lower edge of the shank 13 of the loopers to force the loopers upwardly against the surface 38 of the flange 32. However, a preferable manner of securing the loopers is to provide a notch 71 in the lower edge of the shank 13 of a configuration and size for receiving the clamping member 62*a*, the notch 71** being disposed in alignment with the clamping member when the elements are positioned within the retainer. With this construction only two screw holes need be formed in the body member flange to lock the clamping member and loopers in place and provides a fine gauge mounting block.

Another manner of providing for finer gauge loopers is to form the channel 70 in the surface 40 of the flange 34 so that it opens onto the surface 48 of the retainer while the retainer channel 55 opens onto the surface 38 of the flange 32. A second clamping member 72 having grooves 74 is provided in the channel 70, the grooves 74 being offset from the grooves 64 by a distance substantially equal to one gauge space so that each clamping member 62,72 can engage half the loopers to firmly secure them in the retainer and the body member.

The knife blocks 20 may be constructed in a similar manner to the looper blocks 14, the retainer slots being sized for receiving the shank ends of the knives, and the knives may have notches 71. The construction in either case in such that to change the gauge of the tufting machine only the retainer 44 need be replaced with others having the required spacing between slots 54; the body members 30 need not be replaced and can be used with the various retainers. Moreover, when one or more gauge parts are broken or worn, only those need be replaced and this can be accomplished either by individually removing those required to be replaced while in the tufting machine or by insertion of a replacement retainer having new gauge parts positioned within the slots. In the latter instance the broken or worn parts can be replaced in the original retainer while at a workbench.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A mounting block for a tufting machine for carrying a plurality of gauge parts each having an elongated mounting portion of substantially rectangular cross section, said block comprising a body member having a pair of elongated spaced flanges, a gauge parts retainer having elongated surfaces spaced apart by a distance substantially equal to the spacing between said flanges and positioned intermediate said flanges, means defining an elongated channel in one of said surfaces, means defining a plurality of spaced slots in said retainer extending transversely to said elongated surfaces, each of said slots having a cross sectional configuration corresponding to that of the mounting portion of said gauge parts and extending from the other of said elongated surfaces to and opening into said channel, and gauge parts securing means including a clamping member in said channel for securing said gauge parts in respective slots and for securing the retainer with the body member.

2. A mounting block as recited in claim 1, wherein said flanges and said surfaces are parallel each to the other.

3. A mounting block as recited in claim 2, wherein said gauge parts securing means includes means defining an elongated channel in one of said flanges opening onto the channel defined in said retainer, and wherein said clamping member is disposed in both channels.

4. A mounting block as recited in claim 2, wherein said gauge parts securing means includes means defining an elongated channel in one of said flanges opening into said other of said elongated surfaces, and a second clamping member in the latter channel.

5. A mounting block as recited in claim 4, wherein each of said clamping members includes spaced grooves equal in number to half the number of slots in said retainer, said clamping member being disposed in the respective channel with said grooves facing said slots, and the grooves in one clamping member being offset from the grooves in the other clamping member, each groove being aligned with one slot.

6. A mounting block as recited in claim 2, wherein said gauge parts securing means includes screw means threaded into the flange adjacent said channel and into abutment with said clamping member for forcing said clamping member adjacent the mounting portions of said gauge parts.

7. A mounting block as recited in claim 2, including means extending transversely through one of said flanges for securing said block in a tufting machine.

8. A mounting block as recited in claim 3, wherein the mounting portion of said gauge parts includes a notch for receiving said clamping member.

9. A mounting block as recited in claim 8, wherein said gauge parts securing means further includes screw means threaded into said flange adjacent said channel and into abutment with said clamping member for forcing said clamping member into the notches.

* * * * *